United States Patent [19]

Griffith et al.

[11] Patent Number: 4,677,400

[45] Date of Patent: Jun. 30, 1987

[54] VARIABLE LINE EXTENDER FOR WAVE GUIDE

[75] Inventors: Robert K. Griffith, Goleta; T. Norman Hardy, Santa Barbara; Edley V. McKnight, Lompoc; Vladimir K. Vavra, Santa Barbara, all of Calif.

[73] Assignee: Honeywell Inc., Minneapolis, Minn.

[21] Appl. No.: 721,333

[22] Filed: Apr. 8, 1985

[51] Int. Cl.[4] ..... H01P 5/00; H01P 9/00

[52] U.S. Cl. ..... 333/159; 333/256

[58] Field of Search ..... 333/159, 157, 248, 249, 333/256, 257; 343/757, 778

[56] References Cited

U.S. PATENT DOCUMENTS

| | | | |
|---|---|---|---|
| 3,132,312 | 3/1964 | Corey et al. | 333/159 |
| 3,182,273 | 5/1965 | Meyer | 333/248 |
| 3,495,191 | 2/1970 | Zilkoski | 333/159 |

FOREIGN PATENT DOCUMENTS

| | | | |
|---|---|---|---|
| 624181 | 6/1949 | United Kingdom | 333/248 |
| 1136433 | 12/1968 | United Kingdom | 333/159 |
| 0896700 | 1/1982 | U.S.S.R. | 333/249 |

*Primary Examiner*—Eugene R. LaRoche
*Assistant Examiner*—Benny Lee
*Attorney, Agent, or Firm*—Roger W. Jensen

[57] ABSTRACT

A variable line extender for wave guide comprising an elongated electrically conductive housing member and an electrically conductive slide member, the slide member having a convex shaped rounded end and a U-shaped recess extending transversely continuously from one end of the slide longitudinally along one side thereof, around the rounded end, and then along the other side back to the first end, with said housing having a pair of wave guide shaped ports in register with the U-shaped recess of the slide member. Means are provided for adjusting the relative longitudinal position of the slide with respect to the housing so as to vary the length of the path between the ports.

11 Claims, 15 Drawing Figures

FIG. 2
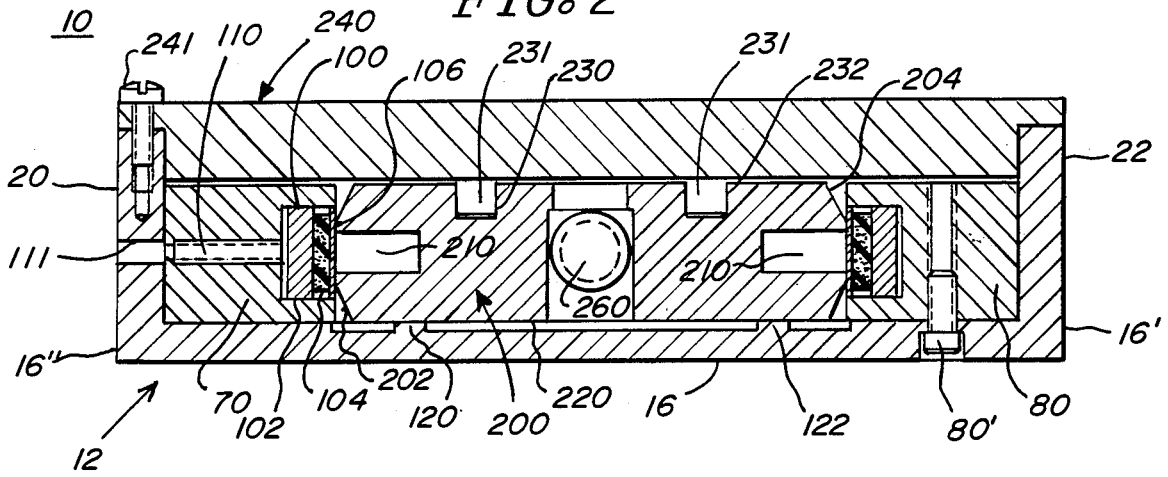
FIG. 4
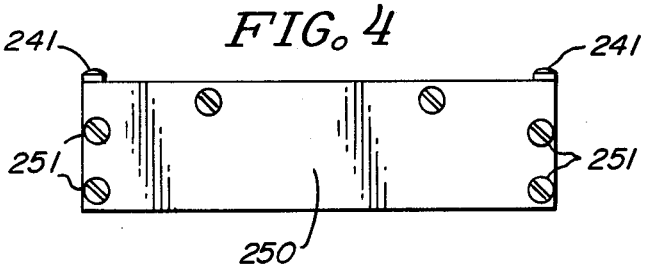
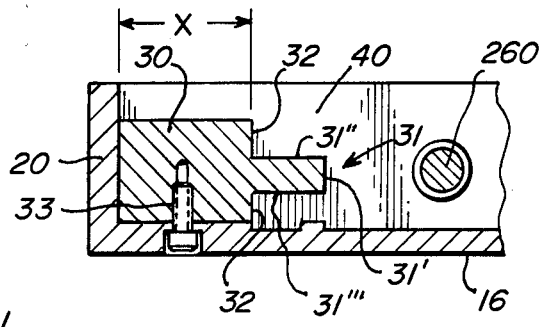
FIG. 11
FIG. 5
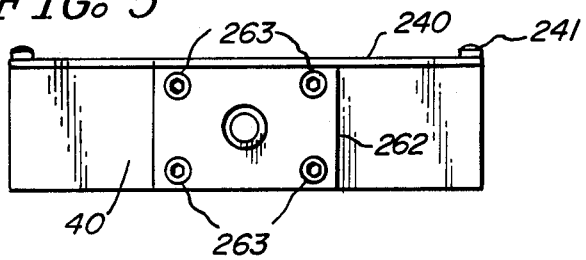
FIG. 6
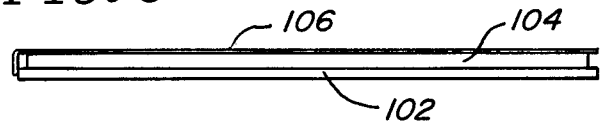
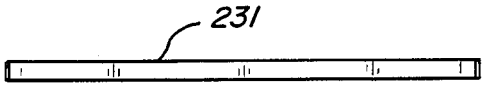
FIG. 13
FIG. 7
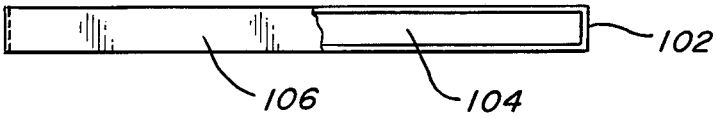
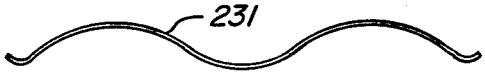
FIG. 14

VARIABLE LINE EXTENDER FOR WAVE GUIDE

SUMMARY OF THE INVENTION

Our invention provides a highly efficient variable line extender for a wave guide. By way of background, those skilled in the art of wave guides, microwave components and systems and the like readily understand the desirability and need for having a means for effectively varying the length of a wave guide connected between two fixed points in a wave guide system. One reason for having such a means for varying the effective length of the wave guide is for accurate tuning of an overall system.

There are three technical criteria which must be satisfied. The first is that the insertion loss must be kept as low as possible; a corollary is that the insertion loss, in addition to being low, must not change, i.e., must be maintained constant over the range of adjustment of the variable line extender. The second criteria is that the voltage standing wave ratio (VSWR) must be kept as low as possible. The theoretical limit or ideal for the VSWR is 1:1 and our invention provides a VSWR which approaches the theoretical limit; more specifically, we have provided with our invention a variable line extender with a VSWR of approximately 1.3:1. The third criteria is that the phase shift should be linear, continususlу variable and have minimal group delay variations.

Our invention achieves the above mentioned technical criteria for full band operation. More specifically, one embodiment of our device is for the Ka band, i.e., 26.5–40 GHz, this also having the industry standard notation of WR28. Our invention is also suitable for lower frequencies and higher frequencies.

Prior attempts have been made to provide variable line extenders but they have all been characterized by having one or more very significant problems that rendered them nonsatisfactory. Such prior art arrangements either had too high an insertion loss, the insertion loss varied as the device was adjusted, the device had too high a voltage standing wave ratio and/or the device had high group delay variations.

Briefly, our invention provides a variable line extender or wave guide comprising an elongated electrically conducted housing member within which is disposed an electrically conductive slide member. The cooperating surfaces of the slide member and the housing member are uniquely arranged, as will be detailed below, so that the slide member may be moved longitudinally relative to the housing member so as to effectively vary the length of the wave guide line while maintaining a relatively low insertion loss constant; the apparatus also having a very low VSWR.

BRIEF DESCRIPTION OF THE DRAWINGS

FIG. 2 is an enlarged transverse cross-section of the apparatus of FIG. 1 taken along section lines 2—2, FIG. 11 is a cross-sectional view of the apparatus of FIG. 1 as viewed along section lines 11—11 thereof, FIGS. 13 and 14 are plan and side views respectively of a spring means used in the apparatus of FIG. 1.

DETAILED DESCRIPTION

Figure 1:
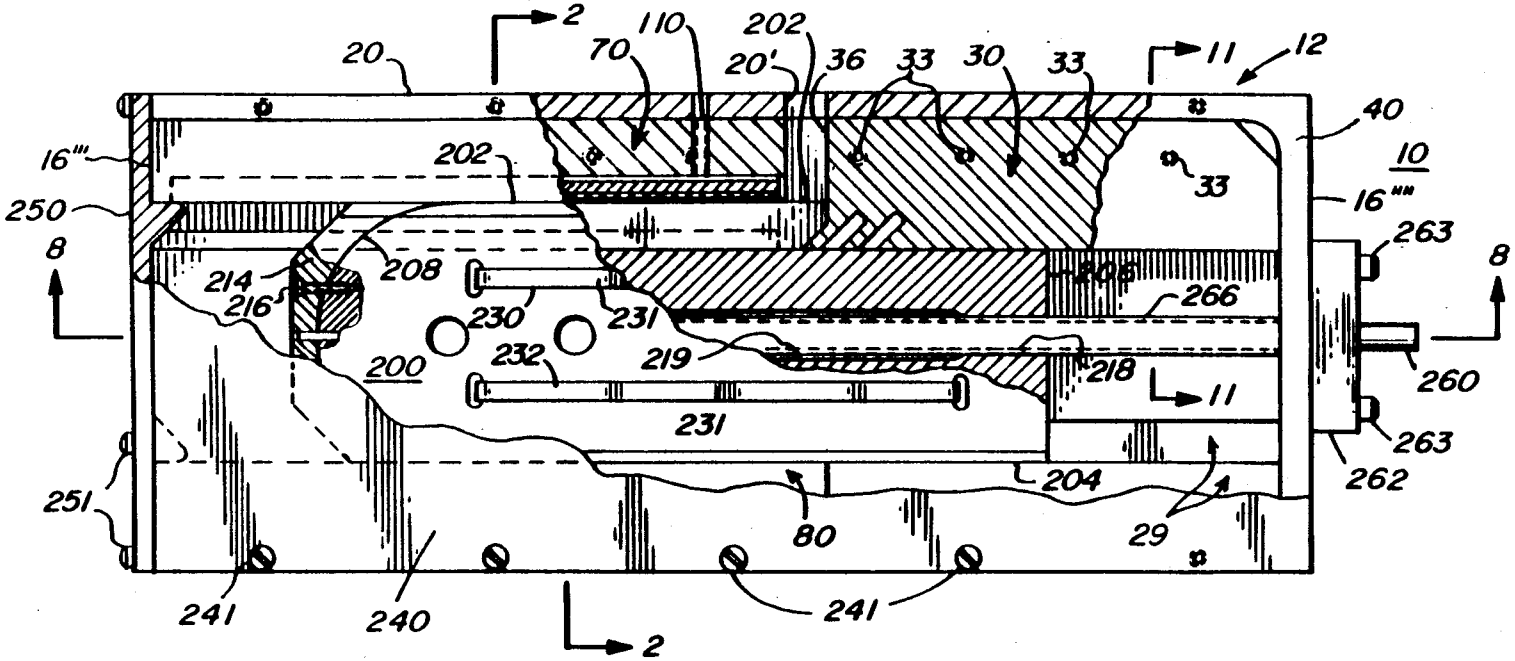
FIG. 1 shows a plan view of the assembled housing and slide member, partially cut away to show internal details.

The variable line extender for wave guide depicted in the drawings is intended to be used with, i.e., connected to wave guide of a predetermined size, the size of the wave guide being arbitrarily designated by the dimension "h" for the height and by the dimension "w' for the width. It will be understood by those skilled in the art that obviously the dimensions h and w may vary depending upon the frequency and other applicational requirements of the overall system in which the extender is used.

Figure 3:
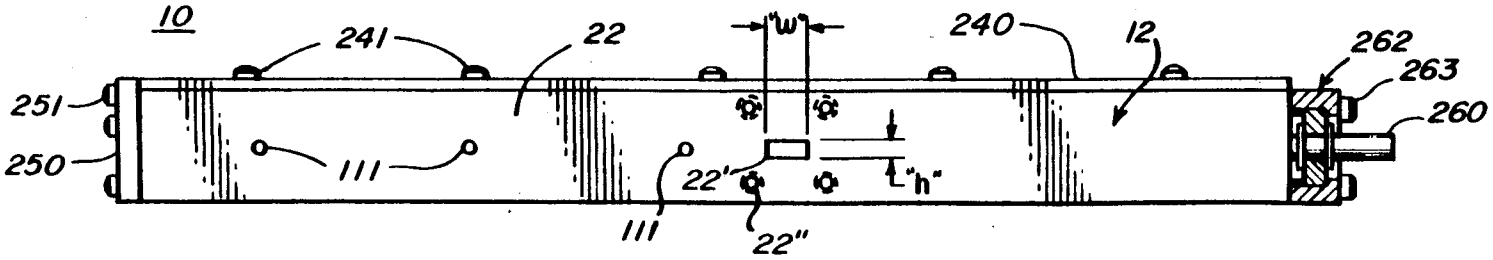
FIG. 3 is a side view of the extender shown in FIG. 1, FIGS. 4 and 5, respectively, are the left and right end views of the apparatus as shown in FIG. 1, FIGS. 6 and 7 are respectively a side view and a plan view of a contact assembly for the apparatus of FIG. 1.

Referring, in particular, to FIGS. 1 and 2, the variable line extender is generally designated by the reference numeral 10 comprising an elongated electrically conductive housing member 12 having mutually perpendicular longitudinal transverse and vertical axes. The longitudinal and transverse axes lie in the plane of the paper for FIG. 1. The transverse and vertical axes lie in the plane of the paper for FIG. 2. The housing member 12 comprises a flat-like base portion 16 having two longitudinal sides 16' and 16'' (see FIG. 2) and two ends 16''' and 16''''(see FIG. 1). The base portion 16 has first and second longitudinal side wall portions 20 and 22 extending perpendicular from said base portion 16 in fixed spaced apart parallel relationship to one another along and normal to said longitudinal sides 16' and 16''. The side wall portions, being perpendicular to the base portion, are thus parallel to the aforesaid vertical axis. Further, each of the side wall portions 20 and 22 are further characterized by having a wave guide-shaped port passing therethrough (of h x w dimensions). The wave guide port for side 20 has the reference numeral 20' (see FIG. 1) and the port for side 22 has the reference numeral 22'(see FIG. 3). With further reference to FIG. 3, it will be noted that the height and the width of port 22'had been designated by the dimensions "h" and "w" respectively. The axes of ports 20' and 22' are preferably in alignment with one another and are parallel to the aforesaid transverse axis. A representative size of port openings 20' and 22' for a Ka band extender would be dimension "w" being 0.280 inches and "h" being 0.140 inches.

At end 16'''' of base portion 16 is an end wall portion which connects the ends of side wall portions 20 and 22.

The side wall portions 20 and 22 also have transversely inwardly extending flange portions or means longitudinally disposed from one side of the inner end of the port toward end 16'''' of the base 16. For example, side wall portion 20 (see FIG. 1) has a transversely inwardly extending flange portion which, in the embodiment shown, is a separate insert 30 which extends longitudinally from one side of port opening 20'longitudinally toward end 16'''' of the base. The corresponding insert for side wall portion 22 is identified in FIG. 1 by the reference numeral 29.

Inserts 30 and 29 are fixed to the bottom 16 of housing 12 by appropriate screw means 33 (see FIGS. 1 and 11). With further reference to FIG. 11 which shows a cross-section of insert 30, it will be noted that the insert extends transversely to a vertical surface 32. The actual transverse flange is designated by reference numeral 31 and it (as shown in FIG. 11) extends transversely from the center part of surface 32, the upper and lower surfaces 31'' and 31''' thereof, and the end surface 31' thereof being slightly less than dimensions "w" and "h" respectively.

Figure 10:
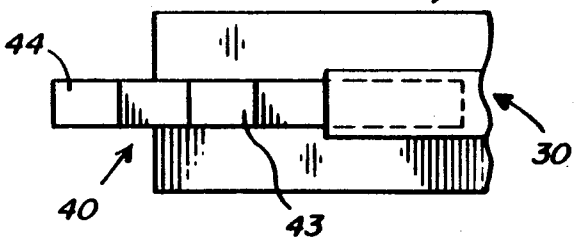
FIGS. 9 and 10 are enlarged details of a noncontact filter means provided in the housing member, FIG. 9 being a side view and FIG. 10 being a bottom view thereof.

Each of the inwardly extending flanges 30 and 29 have a first longitudinal end the surface of which is adapted to exactly match with one side of the associated wave guide port. More specifically, and by way of example, insert 30 has an end 36 (see FIG. 1) which is aligned exactly with one side of port 20'. The transverse width of surface 36, labeled "x" as shown in FIG. 11, is an important dimenLion and will be referred to below in connection with a discussion of additional housing inserts 70 and 80. FIG. 10 shows a side view of the insert 30 and flange 31.

Figure 9:
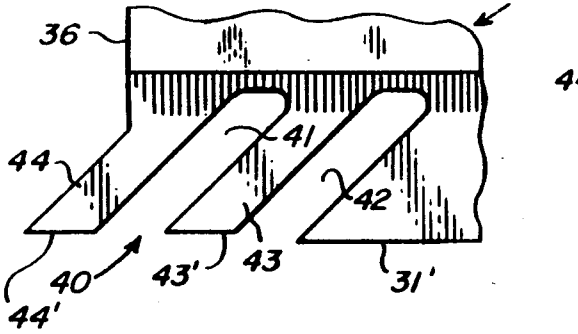
Figure 12:
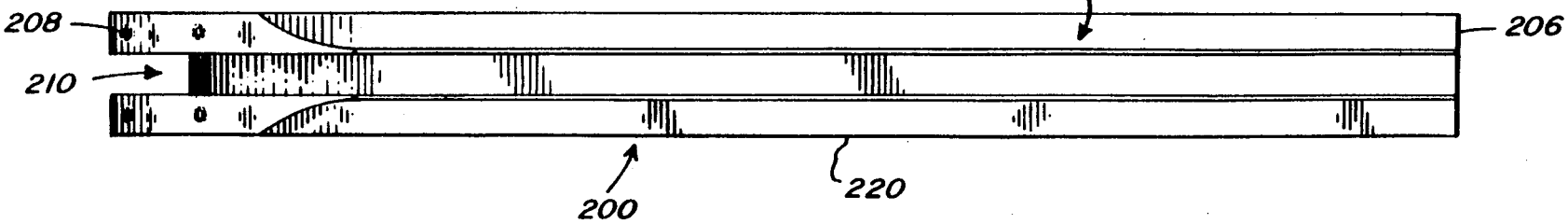
FIG. 12 is a side view of the slide member.

At the longitudinal end of the flange 31' most adjacent to the port 20' is a noncontact filter means 40 shown best in FIGS. 9 and 10. The noncontact filter means 40 for insert 30 comprises a pair of slots 41 and 42 extending parallel to one another and at an approximate 45 degree angle to both the longitudinal and transverse axes. A first finger 43 is defined between slots 41 and 42 and a second finger 44 defines one side of slot 41. The inner surfaces of fingers 43 and 44 are identified by reference numerals 43' and 44'respectively; it will be noted from FIG. 9 that they are slightly outboard of the inner surface 31' of the flange portion 31. Also, it will be noted from FIG. 10 that the fingers 43 and 44 are slightly narrower (in a vertical axis sense) than the flange 31..

Insert 29 has a flange and noncontact filter means (not specifically shown) corresponding in location, size and function to flange 31 and noncontact filter means 40 of insert 30.

Figure 15:
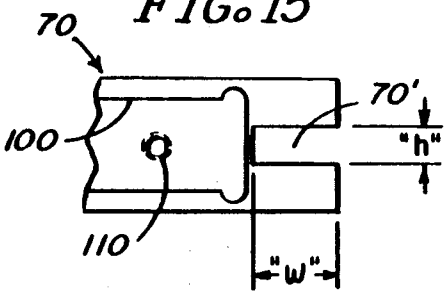
FIG. 15 is an enlarged detailed view of part of the housing.

The above mentioned additional inserts 70 and 80 are shown from a longitudinal standpoint in FIG. 1 and are also clearly shown in the cross-sectional view of FIG. 2. The transverse width of the inserts 70 and 80 (see FIG. 2) is substantially the same as dimension "x" of inserts 30 and 29 (see FIG. 11). The inserts 70 and 80 are positioned on base 16 adjacent to side walls 20 and 22 and in end to end abutting relationship with the ends of inserts 30 and 29. Each of inserts 70 and 80 has a U-shaped recess at one end thereof which abutts inserts 30 and 29 respectively (see FIG. 15 for insert 70). In FIG. 15, the U-shaped recess is identified by reference numeral 70', the recess is of a width "w" and a height "h"Thus, when inserts 30 and 70 are positioned in and secured to the housing, the U-shaped recess 70' is abutting against flat surface 36; thus a port extension of "h" by "w" dimension is provided exactly aligned with port 20'. A corresponding port extension is provided by inserts 29 and 80 and is likewise in exact alignment with port 22'. The inserts 70 and 80 are adapted to be fastened to the bottom of the base 16 by appropriate screw means 80' (see FIG. 2). As indicated, the transverse width of the inserts 70 and 80 is selected to be the same as the primary transverse width "x" of the inserts 30 and 29.

Each of the inserts 70 and 80 has a longitudinally extending recess along the inner vertical surface, the recess extending longitudinally from a point adjacent to the aforementioned U-shaped recess to a point adjacent the other end 16''' of the base member. The longitudinal extent of this recess is best shown in FIG. 1. The recess has a significant transverse depth as is best shown in FIG. 2. Referring to insert 70, as shown in FIG. 2, it will be noted that the recess is identified by reference numeral 100. Disposed in recess 100 is a flat elongated rigid pressure plate 102 positioned in the bottom of the recess. Adjacent to pressure plate 102 is a flat elongated resilient gasket means 104. Positioned adjacent to the gasket means 104 is an electrically conductive flat flexible elongated seal means 106, the subassembly 102-104-106 also being depicted in FIGS. 6 and 7.

Each of the inserts 70 and 80 has three transversely oriented adjustment screws longitudinally spaced from each other. The inner surface or end of each screw abuts against the outer surface of flat elongated rigid pressure plate means 102. For example, in FIG. 2 one of the above mentioned screw means is identified by reference numeral 110; also it will be noted that access for an appropriate tool for turning screw 110 is provided by an aperture 111 in side 20 of the housing. FIG. 3 shows three apertures 111 for providing access for the three adjustment screws 110 for insert 80.

A pair of parallel boss portions 120 and 122 are provided on the upper surface of the base portion 16. The top surfaces of boss portions 120 and 122 are coplanar and parallel to the transverse axis.

Figure 8:
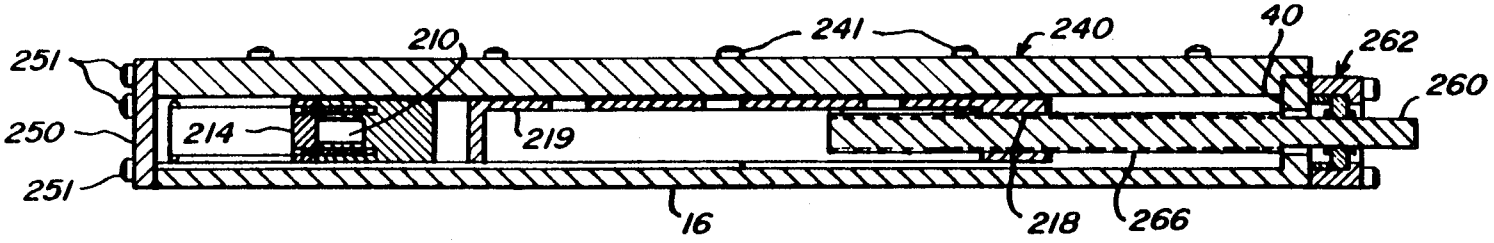
FIG. 8 is a longitudinal cross-sectional view of the apparatus shown in FIG. 1 as viewed along section lines 8—8 thereof.

The variable line extender 10 further comprises an electrically conductive slide member 200 having an elongated flat shape with two longitudinally extending parallel sides having respective beveled edges 202 and 204 extending from a first end 206 to a convex shaped rounded end 208 (see FIG. 1). The slide member 200 is further characterized by having a U-shaped recess of h $\times$ w dimensions extending transversely continuously from said first end 206 longitudinally along side 202, around the rounded end 208 thereof, and thence along the other side 204 back to the first end 206 thereof. The U-shaped recess of the slide member 200 is designated by reference numeral 210 and is shown both in FIGS. 2 and 8.

Slide member 200 has an end cap 214 having an inner concave flat surface sized to exactly complement the rounded convex surface 208. The end cap 214 is attached by suitable screw means 216 to said rounded end 208 so that when the end cap is attached as aforesaid, a passageway of h $\times$ w dimensions is defined therebetween, this being clearly shown in FIG. 8.

The slide member 200 is adapted to be assembled within the housing member (see FIGS. 1 and 2) so that the two opposite parallel sides 202 and 204 are in sliding abutting relationship with the inner surface of the vertical inner conductive flat surface means, i.e., the inner surface of electrically conductive flat flexible elongated seal means 106 (see FIG. 2).

Referring to FIG. 2, and with reference to side 202 of the slide means 200, it will be seen that the outboard extremities of the U-shaped recess 210 are in metal to metal contact with the inner face of the strip 106. Thus, a wave guide-like passageway (of "h" $\times$"w" dimensions) is defined by the coacting slide 200 (with its slot or recess 210) and the vertical conductive flat surface means comprising in part the strip 106 of the housing. The adjustment screws 110 are adjusted to provide a uniform contact pressure between the sides 202 and 204 of the slide and the vertical conductive flat surface means.

It will be further noted in FIG. 2 that the slide means 200 has a lower planer surface 220 which is adapted to abut against the top surfaces of the aforementioned bosses 120 and 122 of the base 16. The dimensions of the slide 200 and of the bosses 120 and 122 are selected so that the U-shaped recess 210 of the slide 200 is exactly in transverse alignment with the ports 20' and 22' as extended by the port extensions between inserts 30/70 and 29/80.

The top surface of the slide 200 has a pair of longitudinally extending recesses 230 and 232 in which are adapted to be disposed a pair of appropriate leaf springs 231 shown in plan and side view in FIGS. 13 and 14 respectively. A cover means 240 (shown best in FIGS. 2, 3 and 8) is attached to the top surfaces of the side wall portions 20 and 22 as well as to the end wall portions by suitable screw means 241.

An end cap 250 is provided at end 16''' of the base portion 16. Suitable screw means 251 are used to attach the end cap 250 to housing 12 (see FIG. 4).

Means are provided for adjusting the relative longitudinal position between the housing member and the slide member. The means depicted in the drawings comprise a shaft 260 supported for angular rotation about its longitudinal axis by a bearing means 262 attached by screw means 263 to the end wall 40 of the housing 16, the axis of shaft means 260 being essentially along the longitudinal axis of the wave guide extender 10. The shaft means 260 extends within the extender, the inner extent of the shaft means 260 being threaded as at 266 (see FIG. 1) and the shaft is adapted to extend into an appropriately threaded hole 218 of the slide member 200 (see FIG. 8).

The shaft means 260 may be controlled by any suitable means, either by a control mechanism or manually. It will be appreciated that rotation of the shaft 260 will, through the aforesaid connection of the threaded portion thereof 266 with the slide 200, cause the slide 200 to be moved longitudinally with respect to the housing 16 either in one sense or the other depending upon the direction of rotation of shaft 260.

It will be understood by those skilled in the art that the above described relative longitudinal movement between the slide and the housing changes the effective length of the wave guide path between ports 20' and 22'.

The extender 10 is easily assembled. The inserts 30, 29, 70 and 80 are attached to the base 16 by screws 80'. The vertical conductive flat surface means (FIGS. 6 and 7) are preassembled and then inserted in recesses 100. Slide member 200 is then carefully inserted into housing along the longitudinal axis (from left to right as shown in FIG. 1) so that the U-shaped recess 210 thereof straddles the flanges 31 of inserts 30 and 32. The slide 200 is thus supported in part by bosses 120 and 122 and in part by flanges 31. Springs 231 are installed and end cap 250 and cover 240 are then attached. The adjustment screws 110 are selectively adjusted to provide uniform pressure between the sides 202 and 204 of the slide member 200.

Slide member 200, housing 12 and cover 240 are, as indicated, electrically conductive. Brass with gold plated surfaces has been found satisfactory. Brass or alloy shim stock material has been found satisfactory for the electrically conductive members 106.

OPERATION

In operation the wave guide line extender depicted in the drawings is intended to be connected into a system having a first wave guide means (not shown) adapted to be connected to the extender 10 at port 20' and with a second wave guide means (also not shown) adapted to be connected to port 22'. Appropriate threaded holes, e.g., 22'' are provided adjacent to ports 22' and 20' respectively (see FIG. 3) for use in attaching the aforementioned wave guide connections for the extender It will be further understood that, as aforesaid, rotation of the shaft 260 will cause relative longitudinal movement between the slide 200 and the housing 16. The slide 200 is supported for such longitudinal movement by both the bosses 120 and 122 as well as the flanges 31 disposed within the U-shaped recesses 210.

The noncontact filter means shown in greatest detail in FIGS. 9 and 10 function to prevent electromagnetic energy from traveling therebetween and the slide member. In this manner we have achieved an arrangement for keeping the insertion loss as low as is possible.

While we have described a preferred embodiment of this invention, it will be understood that the invention is limited only by the scope of the following claims.

We claim:

1. A variable line extender for wave guide having a height "h" and a width "w", said extender comprising:

A. An elongated electrically conductive housing member having mutually perpendicular longitudinal, transverse, and vertical axes, and also having:
   1. a flat-like base portion, having two longitudinal sides and two transverse ends,
   2. first and second longitudinal side wall portions extending perpendicular from said base portion in fixed spaced-apart parallel relationship along said longitudinal sides of said base portion, parallel to said vertical axis, each of said side wall portions being further characterized by having:
      a. a wave guide shaped port (of h× w dimensions) passing through a mid section thereof with the port axis being parallel to said tranverse axis, each port having inner and outer ends having vertical sides of h dimension,
      b. a transversely inwardly extending flange portion longitudingally disposed from one vertical side of the inner end of said port toward one of said transverse ends of said base and in vertical alignment with said port, said flange portion (i) extending transversely inwardly from said inner end of said port to a distance slightly less than the dimension w, and (ii) having non-contact filter means adjacent said one vertical side of said inner end of said port, and
      c. vertical inner conductive flat surface means extending longitudinally from the other vertical side of said inner end of said port toward said other of said transverse ends of said base parallel to said longitudinal axis and in vertical alignment with said port;

B. an electrically conductive slide member having an elongated flat shape with two longitudinally extending parallel sides extending from a first end to a convex-shaped rounded end, said slide member being further characterized by:
   1. having a U-shaped recess of h× w dimensions extending continuously from said first end along one of said sides thereof, around said rounded end thereof, and thence along said other of said sides thereof each to said first end thereof, 2. having an end cap with a concave flat surface attached to said rounded end so that when said cap is attached to said convex-shaped rounded end of said slide member, a Passageway of h× x dimensions is defined therebetween, and 3. being assembled within said housing member so that said two parallel sides of said slide member are in sliding abutting relationship with said vertical inner conductive flat surface means of said side wall portions so as to define therebetween passageways of h× w dimensions, said flange portions extending inwardly into said U-shaped recess of said slide member to thereby provide a sliding support means to permit relative longitudinal mevement between said slide member and said housing member and said slide member being oriented so that said rounded end with attached end cap extends toward the other one of said transverse ends of said base;

C. adjustable means connected to said slide member and to said housing member and adapted, when controlled, to move said slide member longitudinally with respect to said housing member, and D. cover means adapted to be connected to said side wall portions.

2. Apparatus of claim 1 further characterized by said vertical inner conductive flat surface means of each of said side wall portions comprising:

A. a recess along the inner surface of said side wall portion extending longitudinally from a point adjacent to said inner end of said port to a point adjacent the other of said transverse ends of said base in alignment with said port, B. flat elongated rigid pressure plate means positioned in the bottom of said recess, C. flat elongated resilient gasket means positioned adjacent to said pressure plate means, and D. electrically conductive flat flexible elongated seal means positioned adjacent to said gasket means.

3. Apparatus of claim 2 further characterized by including adjustment means connected between said housing member and said pressure plate means and adapted, when controlled, to vary the pressure of contact between said flat flexible seal means and said two opposite sides of said slide member.

4. Apparatus of claim 3 further characterized by said adjustment means comprising a plurality of screw means deployed longitudinally along said side wall portions having their rotational axes parallel to said transverse axis, in register with said side wall recesses, and with inner end surfaces of said screw means in contact with said pressure plate means so that selective adjustment of said screw means effects selective longitudinal variation of pressure between said vertical flat surface means and said sides of said slide member.

5. Apparatus of claim 1 further characterized by said slide member being supported on said flat-like base portion.

6. Apparatus of claim 5 further characterized by said base portion having a plurality of co-planar bosses extending longitudinally for supporting said slide member.

7. Apparatus of claim 6 further characterized by said slide member having a coplanar bottom surface adapted to slidingly abut agianst said co-planar bosses.

8. Apparatus of claim 1 further characterized by having a transverse end wall portion at said one of said ends extending normal to said base portion and connecting said first and second side wall portions at one end thereof.

9. Apparatus of claim 1 further characterized by having a cover means connected to the top longitudinal surfaces of said longitudinal sides of said housing member and having a flat underside adapted to be disposed parallel to the top surface of said slide member.

10. Apparatus of claim 9 further characterized by said slide member having longitudinally extending recesses in the top thereof, and spring means disposed in said slide member recesses and in contact with said cover means whereby to develop a spring bias against said slide member to maintain engagement between said slide member and said bosses.

11. Apparatus of claim 1 further characterized by said slide member being supported for controlled longitudinal movement relative to said housing member by (i) a plurality of co-planar bosses longitudinally and (ii) said transversely inwardly extending flange portions.

* * * * *